US006899225B2

(12) United States Patent
Shuert

(10) Patent No.: US 6,899,225 B2
(45) Date of Patent: May 31, 2005

(54) YARN PACK

(76) Inventor: Lyle H. Shuert, 70 Kingsley Manor Dr., Bloomfield Hills, MI (US) 48304

( * ) Notice: Subject to any disclaimer, the term of this patent is extended or adjusted under 35 U.S.C. 154(b) by 125 days.

(21) Appl. No.: 10/358,689

(22) Filed: Feb. 5, 2003

(65) Prior Publication Data

US 2004/0149611 A1 Aug. 5, 2004

(51) Int. Cl.[7] ..... B65D 85/66; B65D 85/04

(52) U.S. Cl. ..... 206/392; 108/55.1; 108/57.16; 206/386; 206/403; 206/557

(58) Field of Search ..... 108/51.11, 55.1, 108/57.16, 901; 206/203, 391, 392, 394, 403, 413, 416, 386, 557, 562, 565, 599

(56) References Cited

U.S. PATENT DOCUMENTS

| | | | | | |
|---|---|---|---|---|---|
| 4,209,094 | A | * | 6/1980 | Bly | 206/427 |
| 4,618,059 | A | * | 10/1986 | Cochran | 206/392 |
| 4,667,823 | A | * | 5/1987 | Wolfe et al. | 206/392 |
| 4,872,560 | A | * | 10/1989 | Langenbeck | 206/557 |
| 5,184,748 | A | * | 2/1993 | Apps | 220/519 |
| 5,390,467 | A | | 2/1995 | Shuert | 52/797 |
| 5,390,789 | A | * | 2/1995 | Darby | 206/391 |
| 5,401,347 | A | | 3/1995 | Shuert | 156/245 |
| 5,470,641 | A | | 11/1995 | Shuert | 428/178 |
| 5,531,327 | A | * | 7/1996 | Darby | 206/600 |
| 5,676,064 | A | | 10/1997 | Shuert | 108/51.1 |
| 5,758,771 | A | * | 6/1998 | Rose | 206/386 |
| 5,794,544 | A | | 8/1998 | Shuert | 108/57.25 |
| 6,079,554 | A | * | 6/2000 | Hammett et al. | 206/203 |

* cited by examiner

*Primary Examiner*—John A. Ricci
(74) *Attorney, Agent, or Firm*—Young & Basile, P.C.

(57) ABSTRACT

A divider for use in handling quantities of yarn spools arranged in layers. The divider includes a main body generally planar polygonal portion and a skirt portion extending around the periphery of the main body portion and formed into a series of circumferentially spaced, arcuate, inwardly opening scallops with each scallop having a curvature substantially matching the curvature of the yarn spools so that, with a layer of spools positioned on the main body portion and the skirt upstanding from the main body portion, each scallop may compliantly engage the outer periphery of an individual outer spool of the spool layer. Each scallop is connected to the main body portion by a strap extending from the main body portion to the scallop and the scallops are connected together to form a continuous circumferential band. Sockets are provided in the main body portion to accommodate the upper or lower ends of the tubes of the yarn spools and a plastic wrap is stretched around the yarn package to enhance the compliance of the scallops to the spools.

20 Claims, 7 Drawing Sheets

YARN PACK

BACKGROUND OF THE INVENTION

This invention relates yarn packs and more particularly to carpet yarn packs.

Quantities of carpet yarn spools are typically handled by piling the spools in a cubicle pile, providing some manner of container or covering for the pile, and then squeezing the sides of the pile together utilizing the clamping arms of a suitable item of powered material handling equipment whereby to enable the pile to be picked up and transferred to a desired location. When these yarn spools are formed there is a large tolerance or variation in the size of the spools so that when all of the spools are stacked together the overall package may differ in overall size. However, in order to insure that the stack of spools may be picked up successfully in the side squeezing operation, it is important that each of the individual spools be tightly packaged together to make a solid bulk or block package that can be engaged and successfully picked up by the clamping arms of the material handling equipment.

SUMMARY OF THE INVENTION

This invention relates to an improved yarn pack.

More particularly, this invention relates to an improved divider for use in packaging and handling spools of yarn.

The divider of the invention includes a main body, generally planar, polygonal portion, and a skirt portion extending around the periphery of the main body portion and formed into a series of circumferentially spaced arcuate inwardly opening scallops with each scallop having a curvature substantially matching the curvature of the yarn spools. With a layer of spools positioned on the main body portion and the skirt upstanding from the main body portion, each scallop may engage the outer periphery of an individual outer spool of the spool layer to insure that all of the spools are engaged and that the stacked spools may be successfully transported.

According to a further feature of the invention, a portion of the divider material constituting each scallop is removed to enhance the ability of the scallop to comply with the configuration of the respective yarn spool. This construction allows each individual scallop to individually comply with the respective yarn spool to insure that all of the yarn spools are firmly engaged.

According to a further feature of the invention, each scallop is connected to the main body portion by a strap extending from the main body portion to the scallop and the scallops are connected together to form a continuous circumferential band of scallops. This specific arrangement has been found to provide the desired compliance as between the scallops and the engaged spools.

According to a further feature of the invention, each strap connects to a central region of each scallop. This specific scallop construction has been found to maximize the complying ability of the scallops.

According to a further feature of the invention, each spool comprises yarn material wrapped around a central tube and the divider main body portion further includes sockets sized and distributed to accommodate the ends of the respective tubes of the yarn spools. This arrangement allows the divider to locate the individual spools without limiting the lateral movements of the individual spools.

According to a further feature of the invention, the sockets are provided on an upper face of the main body portion and further sockets are provided in a lower face of the main body portion in respective alignment with the sockets in the upper face. This arrangement allows the divider to accommodate the upper ends of the tubes of spools in a lower layer and the lower ends of the tubes of spools in an upper layer.

According to a further feature of the invention, the sockets are oversized with respect to the diameter of the yarn spool tubes with the extent of oversize increasing progressively in proportion to the distance from the geometric center of the main body portion. This arrangement recognizes the likelihood, based on the irregular sizes of the spools, that a particular spool will be offset from a theoretical, mathematical location on the main body portion of the divider. In the disclosed embodiment the sockets have a slot configuration with the primary axis of each slot intersecting the geometric center of the main body portion so that the tubes of the individual spools may adjust along the primary axis of the receiving slots in compensation for variations in the spool diameters.

The invention also provides a method of handling a layer of yarn spools. According to the invention, the method comprises providing a divider having a main body, generally planar, polygonal portion and a skirt portion extending around the periphery of the main body portion and formed into a series of circumferentially spaced, arcuate, inwardly opening scallops with each scallop having a curvature substantially matching the curvature of the yarn spool; positioning one of the dividers on a support surface with the skirt portion upstanding; and positioning a layer of spools on the divider with each scallop of the divider engaging an individual outer spool in the layer. This methodology insures that each outer spool will be firmly engaged during any attempt to pick up the layer of spools in a squeezing operation by suitable material handling equipment.

According to a further feature of the invention methodology, the method includes the further steps of positioning further layers of spools on the spool layer and positioning another of the dividers on top of the top layer of spools with the main body portion overlying the top layer and the skirt portion extending downwardly with each scallop engaging an individual outer spool in the top layer. This arrangement allows the same divider to be utilized as either a base or a lid in a stack of spools and insures that, in each case, all of the outside spools in each layer are firmly engaged to facilitate grasping and movement of the stack.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION OF THE PREFERRED EMBODIMENT

Figure 1:
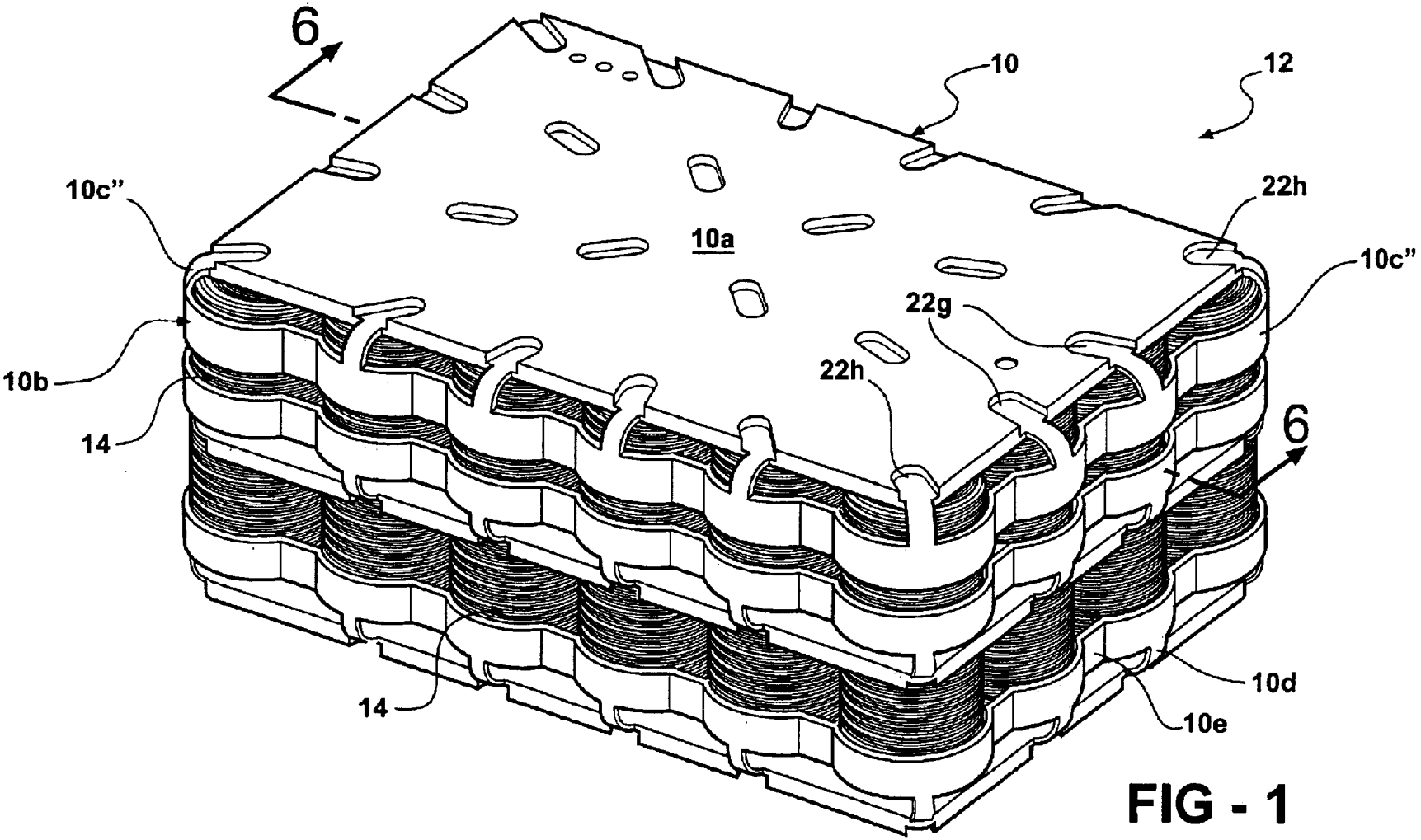
FIG. 1 is a perspective view of a pack of yarn spools according to the invention.

FIG. 1 illustrates the use of a divider 10 according to the invention to form a yarn pack 12 comprising a plurality of yarn spools 14 arranged in stacked layers.

Figure 2:
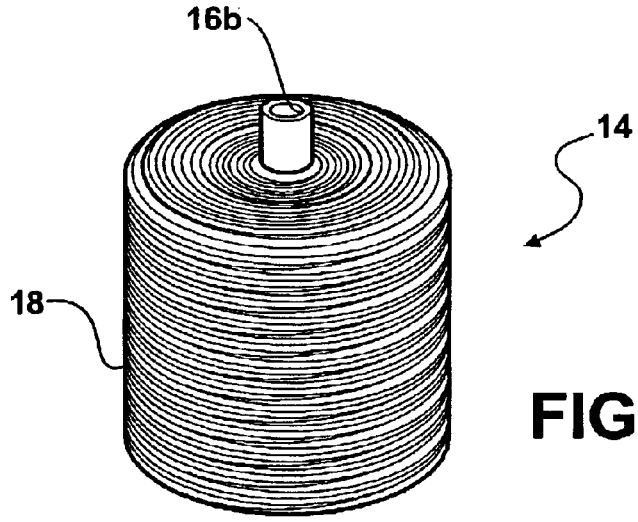
FIG. 2 is a perspective view of a yarn spool.
Figure 3:
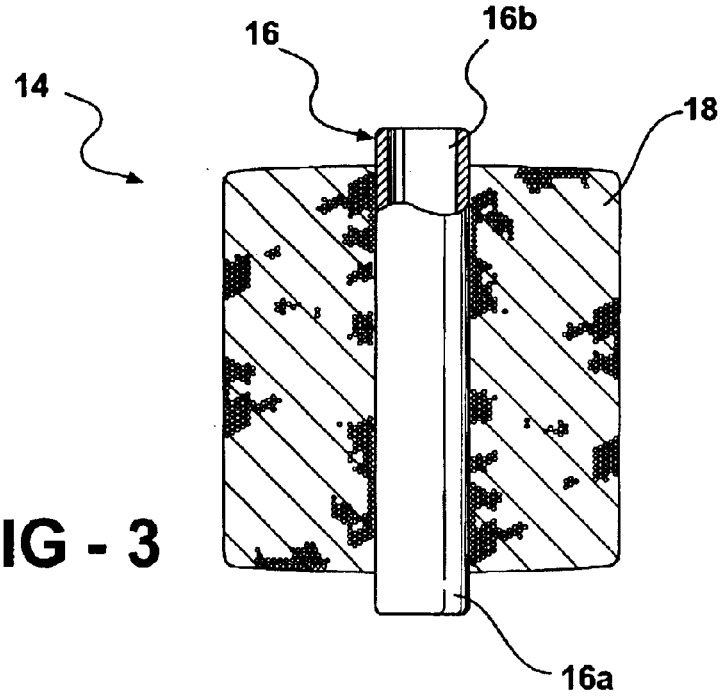
FIG. 3 is a cross-sectional view of a yarn spool.

A typical yarn spool 14 is seen in perspective in FIG. 2 and in cross-section in FIG. 3. Each yarn spool, in known manner, includes a central cardboard tube 16 on which carpet yarn 18 is wound to form the spool. The typical winding operation is such that the amount of spool wound onto the central tube varies significantly so that the overall size of the spool varies significantly especially in diameter.

Figure 4:
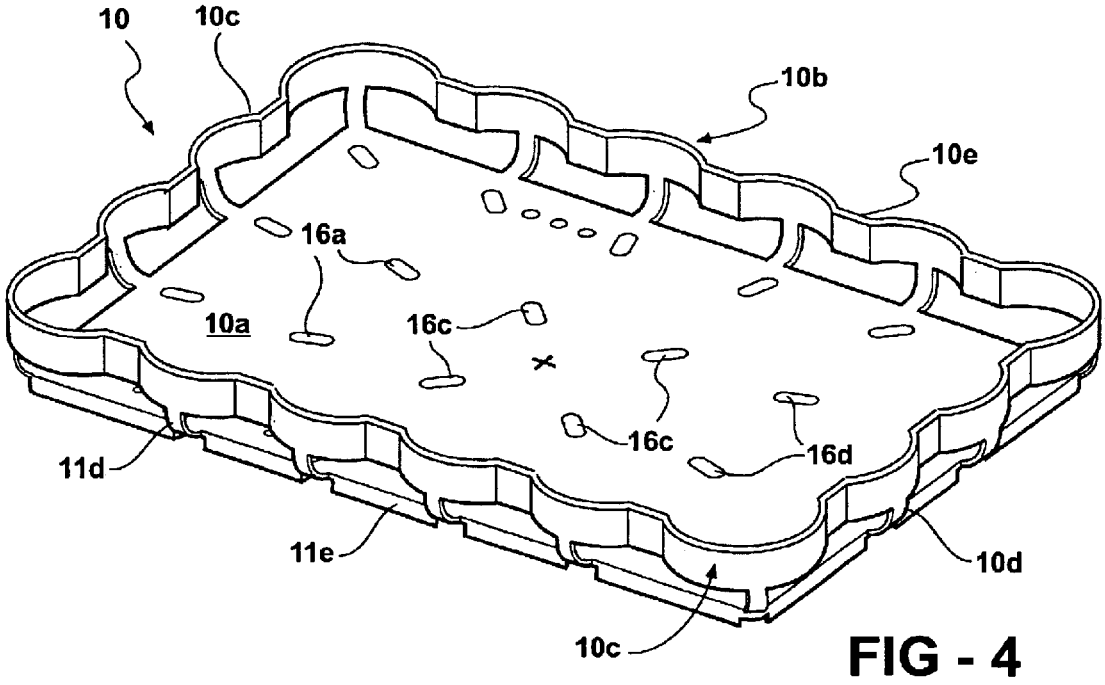
FIG. 4 is a perspective view of a divider according to the invention.
Figure 5:
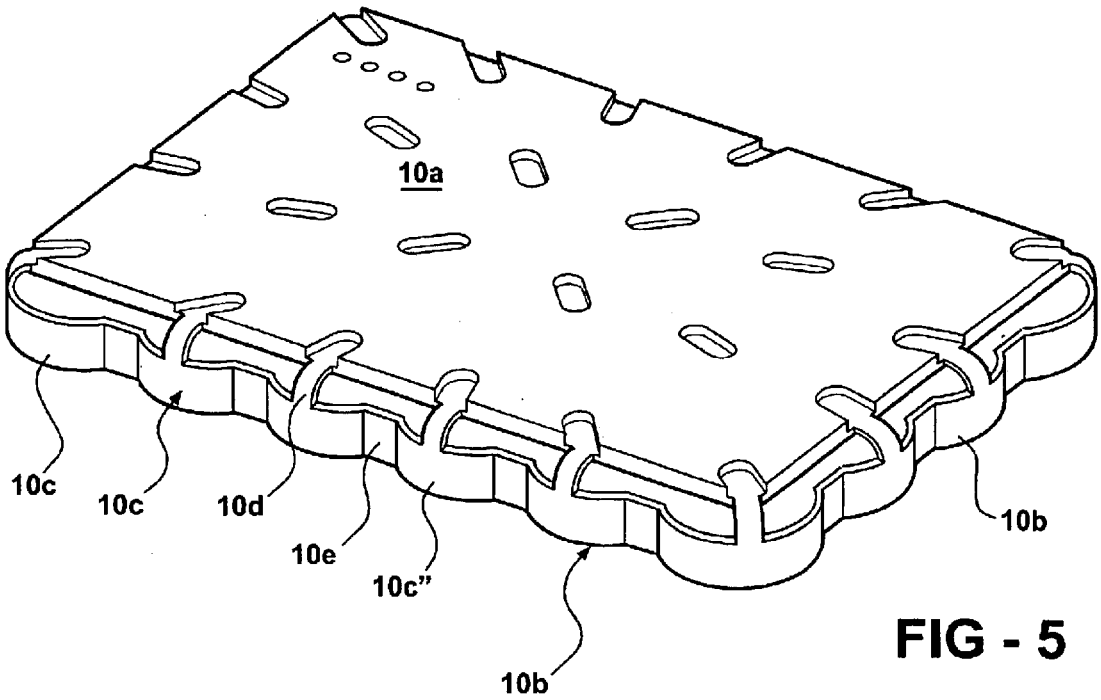
FIG. 5 is a perspective view of the divider in an inverted position as compared to FIG. 4.

With reference to FIGS. 4 and 5, each divider 10 is formed of a suitable plastic material and includes a main body generally planar, rectangular portion 10*a* and a skirt portion 10*b* extending around the periphery of the main body portion and formed into a series of circumferentially spaced arcuate inwardly opening scallops 10*c* having a circular curvature substantially matching the curvature of the yarn spools 14. Skirt portion 10*b* is rectangular to match the peripheral configuration of the main body portion and includes corner scallops 10*c*' and side scallops 10*c*" intermediate the corner scallops. Corner scallops 10*c*' may for example have an arcuate extent of approximately 180° and side scallops 10*c*" may have an arcuate extent of approximately 90°. Each scallop 10*c* is connected to the main body portion 10*a* by a strap 10*d* having an arcuate configuration extending initially outwardly away from the main body portion and then upwardly or downwardly (depending upon the orientation of the divider) to connect to the scallop portion. Each strap will be seen to connect to the respective scallop portion at a central region of the scallop portion, and the scallop portions are joined together by flat portions 10*e* so that the scallops are connected together to form a continuous circumferential band of scallops separated by the flat portions 10*e* and supported in a position either above or below the main body portion by the straps 10*d*.

Figure 8:
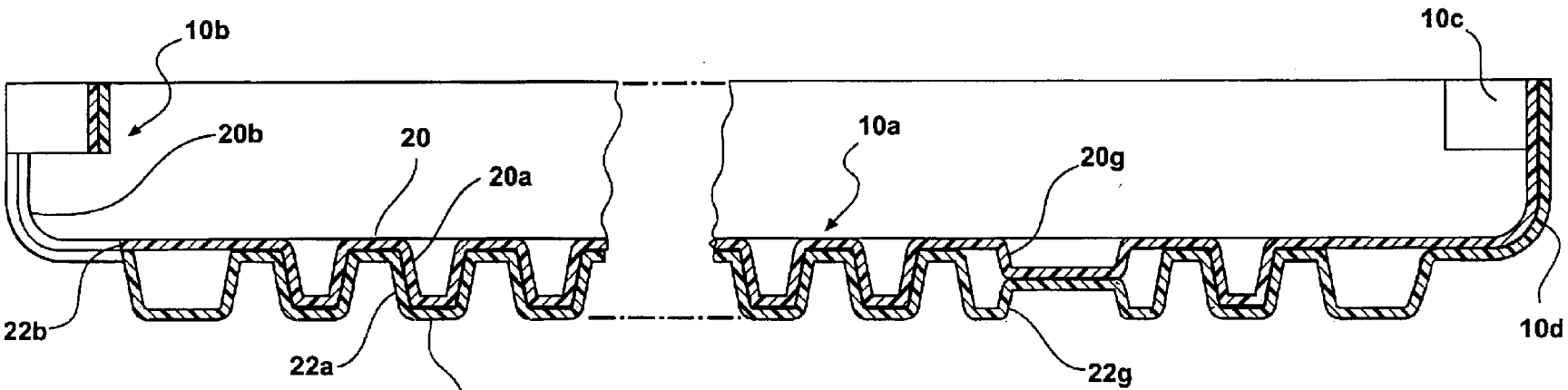
FIG. 8 is a cross-sectional view taken on line 8—8 of FIG. 7.
Figure 9:
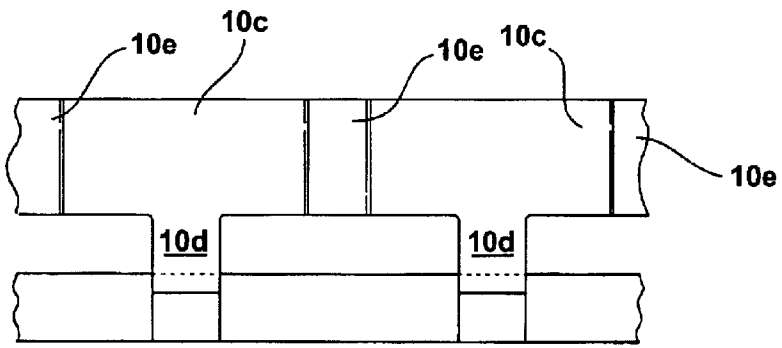
FIG. 9 is a fragmentary elevational view of a skirt portion of an invention divider.

Divider 10 preferably employs a twin sheet construction (FIG. 8) including two sheets 20 and 22 of organic polymer material such as polyethylene which are vacuum formed and fused or knitted together at various points to add structural rigidity. For example, and as shown more fully in U.S. Pat. No. 5,390,467, the platform portion 10*a* of the divider may be formed utilizing rows of hollow bosses 20*a* extending downwardly from the main body of the upper sheet 20 and fused in intermeshing fashion to rows of hollow bosses 22*a* upstanding from the main body of the lower sheet 22. Sheets 20 and 22 further define upstanding skirt portions 20*b* and 22*b* which are fused together to form the skirt 10*b* of the divider. It will be seen that, depending upon the use of the divider, the skirt portion 10*b* may be upstanding with respect to the main body (as seen in FIG. 4) or downstanding with respect to the main body portion (as seen in FIG. 5).

Figure 11:
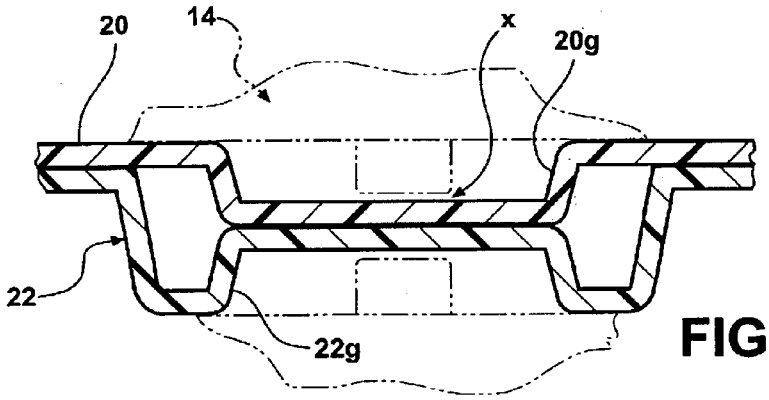
FIG. 11 is a detail view taken within the circle 11 of FIG. 8.
Figure 13:
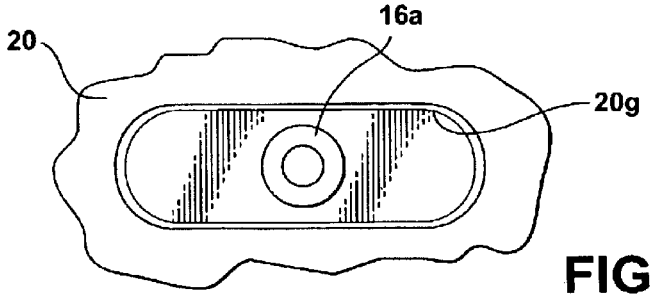
FIG. 13 is a schematic fragmentary view looking in the direction of the arrow 13 in FIG. 11.

Main body portion 10*a* of the divider is further configured to define sockets to accommodate the lower and upper ends 16*a*/16*b* of the tubes 16 of the spools 14. Specifically, sheet 20 is configured to define a series of upwardly opening sockets 20*c*, 20*d*, 20*e*, 20*f*, 20*g*, and 20*h* and sheet 22 is configured to define a series of downwardly opening sockets 22*c*, 22*d*, 22*e*, 22*f*, 22*g* and 22*h* in respective alignment with the corresponding upwardly opening sockets in the sheet 20. As best seen in FIG. 11, illustrating an upwardly opening socket 20*g* and a downwardly opening socket 22*g* in cross-section, the sockets are defined as sections of the sheets 20 and 22 in which no bosses are formed and in which flat portions of the sheets are simply arranged in confronting relation and fused together in a plane intermediate the general planes of the main body portions of the sheets 20 and 22 to form the upwardly opening and downwardly opening sockets. Note that the sockets are axially oversized with respect to the ends 16*a*/16*b* of the spool tubes with the extent of oversize increasing progressively in proportion to the distance of the socket from the geometric center 24 of the main body portion 10*a*. Specifically, the sockets have a slot configuration with the primary axis of each slot intersecting the geometric center 24 of the main body portion, and the length of the slots increase in proportion to the distance from the center 24. Note further (FIG. 13) that the sockets are also oversized in width with respect to the ends 16*a*/16*b* of the spool tubes so that the sockets accommodate the spool tube ends but allow movement of the tube ends both axially and laterally with respect to the slots. Note further that the depth of the sockets exceeds the extent to which the tubes project from the ends of the spools so that a clearance "x" is defined between the upper and lower ends of the socket spools and the floor (or roof) of the respective socket.

Figure 7:
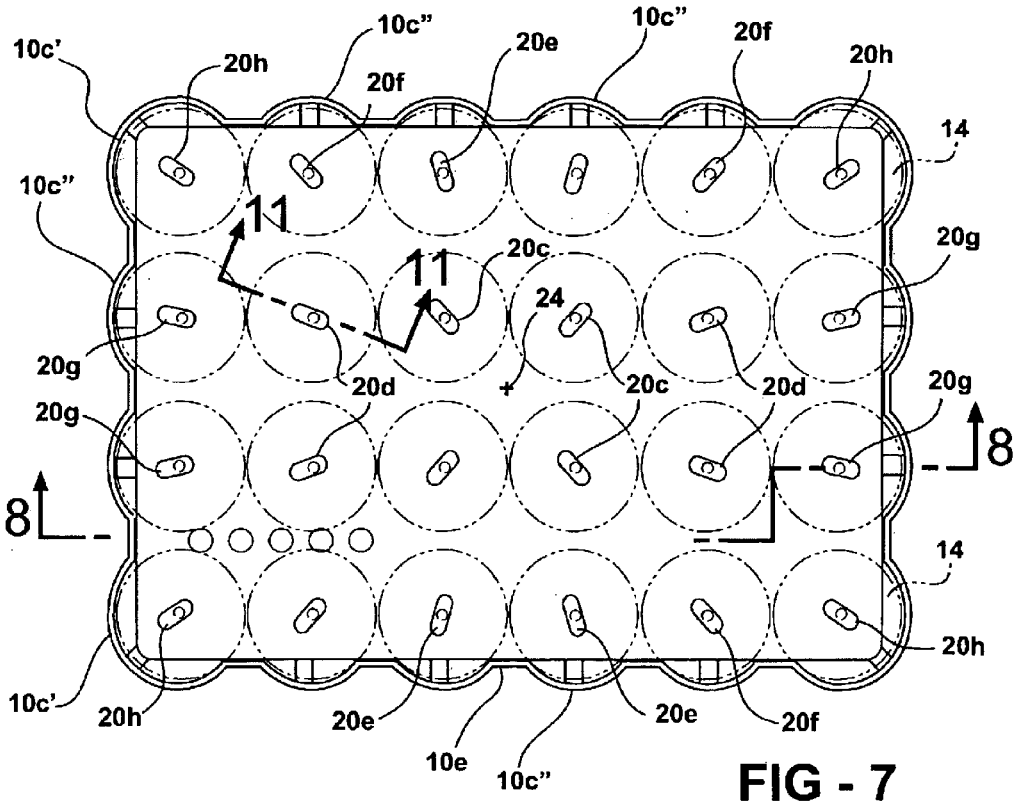
FIG. 7 is a cross-sectional view taken on line 7—7 of FIG. 6.

In the use of the invention divider to form a yarn pack, a divider is positioned on a suitable support surface with the skirt 10*b* upstanding and a plurality of spools of yarn 14 are loaded onto the main body portion of the divider with the lower end 16*a* of the tube 16 of each spool received in a respective socket 20*c*–20*h* in the main body portion. For example, as is best seen in FIG. 7, a total of twenty-four (24) spools may be arranged on the main body portion of the divider in four (4) rows of six (6) spools each. It will be seen that a significant arcuate outer portion of each outer spool in the sixteen (16) spool array is firmly engaged by a scallop 10*c* of the divider.

Note that the lower end portions 16*a* of the tubes of the spools furthest from the geometric center 24 of the main body portion of the divider are received in the axially longest sockets, so that, irrespective of cumulative tolerance stack-ups resulting from the significant variations in the diameter of the spools, the lower end 16*a* will be accommodated axially in the respective socket. One or more further spool layers may now be superimposed on the layer positioned on the main body portion of the divider.

Figure 6:
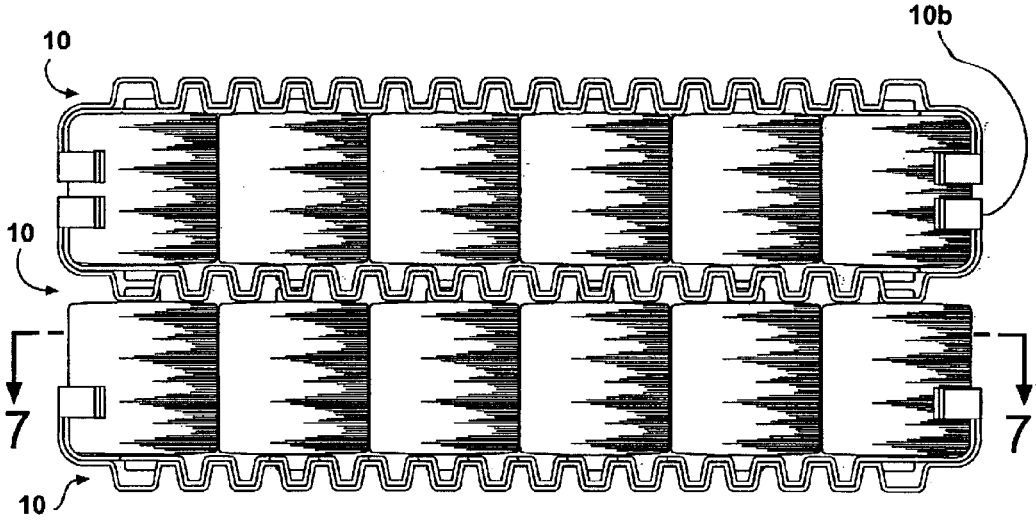
FIG. 6 is a cross-sectional view taken on line 6—6 of FIG. 1.

For example, and as seen in FIGS. 1 and 6, a further divider 10 may be positioned on top of the bottom layer of spools with the skirt upstanding and with the downwardly opening sockets 22*c*–22*h* of the second divider respectively receiving the upper ends 16*b* of the tubes of the lower level spools; a second layer of spools 14 may be positioned on the main body portion of the second divider with the lower ends 16*a* of the tubes of the spools positioned respectively in the upwardly opening sockets 20*c*–20*h* of the second divider; and a third or top divider may be positioned over the second layer of spools with the skirt extending downwardly and with the upper ends 16*b* of the tubes of the spools of the second layer received in the respective downwardly opening sockets 22*c*–22*h* defined in the lower face of the main body portion of the top divider. It will be seen that a total of forty-eight (48) spools are accommodated in the package of FIGS. 1 and 6 with the upstanding skirt on the first, bottom divider covering a portion of the spools in the lower layer and the downstanding skirt on the third, top divider coacting with the upstanding skirt on the second, middle divider to cover substantially all of the spools in the top layer. Additional layers may obviously be added to increase the number of spools accommodated in the package.

The yarn package is completed by tensioning a plastic stretch wrap 27 around the entire package.

Figure 12:
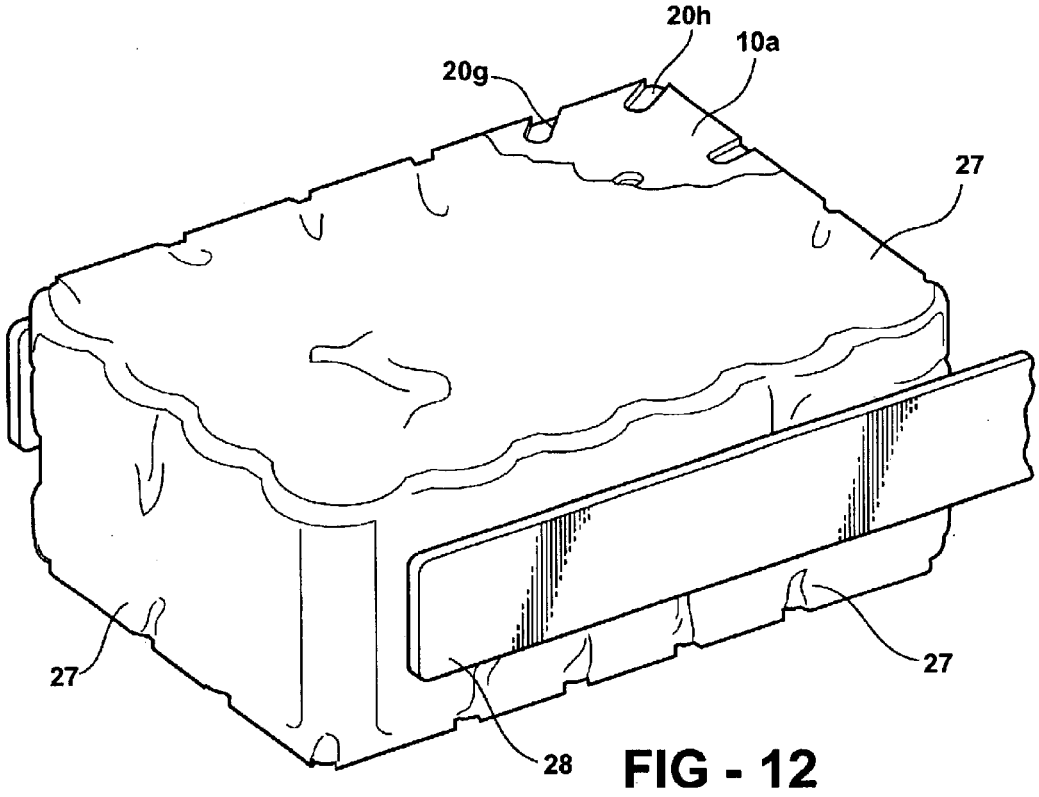
FIG. 12 is a perspective view showing the packaging and lifting of a pack of yarn spools according to the invention.

In use, when the arms 28 (FIG. 12) of an item of material handling equipment, such as a squeeze truck, are moved inwardly against the sides of the package to squeeze the package, the individual scallops 10*c* coact with the individual spools engaged thereby to insure that each outer spool in each spool layer is engaged and thereby insure that the pack may be lifted as a unit without dislodging any of the spools. The ability of the scallops to conform to the respective spools is enhanced by the straps 10*d* connecting the scallops to the main body portion so that, even in a situation where, due to significant variations in the diameter of the spools, the outer perimeter of the spool package is very irregular and non-symmetrical, the scallops will nevertheless, due to the individual embracing of the spools and due to the ability to move compliantly relative to the spools, firmly embrace all of the outside spools and ensure that the entire package may be lifted as a unit.

Figure 10A:
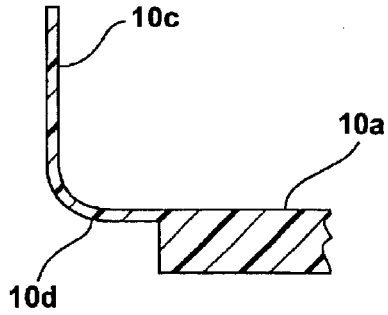
FIGS. 10*a*, 10*b* and 10*c* are cross-sectional views taken respectively on lines 10*a*—10*a*, 10*b*—10*b* and 10*c*—10*c* of FIG. 10.
Figure 10:
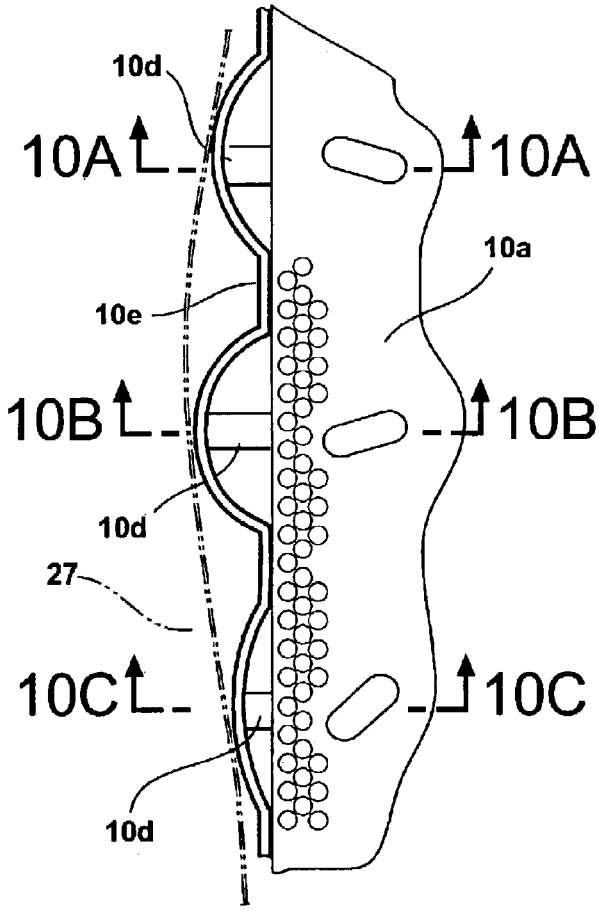
FIG. 10 is a fragmentary plan view of the skirt portion of the invention divider.
Figure 10B:
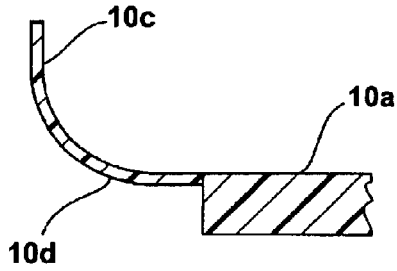
Figure 10C:
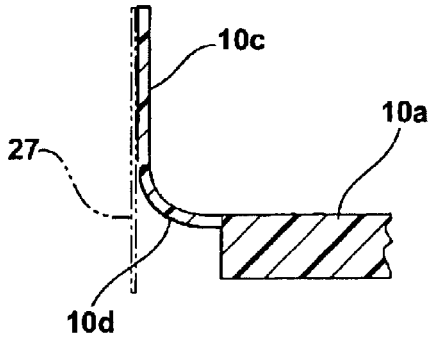

The ability of the individual scallops to accommodate variations in the size of the associated spools is best seen in FIG. 10 in conjunction with FIGS. 10*a*, 10*b* and 10*c*. Specifically, the scallop at the top of FIG. 10, and as seen in FIG. 10*a*, is in a normal or relaxed configuration to accommodate a normal size spool; the scallop at the center of FIG. 10, and as seen in FIG. 10*b*, is stretched outwardly via the strap 10*d* to accommodate a larger than normal size spool; and the scallop at the bottom of FIG. 10*d*, and as seen in FIG. 10*c*, is moved inwardly via the strap 10*d* to accommodate a smaller than normal size spool. As also seen in FIG. 10, the stretch wrap 27 coacts with the scallops to pull the individual scallops tightly against the individual spools to insure that each of the yarn spools is engaged and that all of the yarn spools are bundled together tightly in the final package so that the squeeze truck may successfully and readily pick up the package with the assurance that the package will remain intact. Note that as the spools move together in the package in response to engagement by the scallops and/or in response to the squeezing action of the stretch wrap, the ends of the spool tubes are free to move either laterally or axially in the respective sockets so as not to restrict the ability of the spools to seek out a position in which all of the spools are tightly bunched together.

The invention will be seen to provide an apparatus and a methodology for positively and surely handling large quantities of yarn spools even when, as is common, the spools vary significantly in size.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A divider for use in handling quantities of yarn spools arranged in layers, the divider including:

a main body generally planar polygonal portion; and a skirt portion extending around the periphery of the mainbody portion and formed into a series of circumferentially spaced, arcuate, inwardly opening scallops with each scallop having a curvature substantially matching the curvature of the yarn spools so that, with a layer of spools positioned on the main body portion and the skirt upstanding from the main body portion, each scallop may compliantly engage the outer periphery of an individual outer spool of the spool layer, the skirt portion being connected to the main body portion by a series of circumferentially spaced flexible straps allowing each scallop to selectively move outwardly or inwardly to accommodate spools of varying sizes.

2. A divider according to claim 1 wherein each strap extends from the main body portion to a respective scallop.

3. A divider according to claim 2 wherein the individual scallops are connected together by flat portions.

4. A divider according to claim 1 wherein:

each spool includes yarn material wrapped around a central tube; and the main body portion further includes sockets sized and distributed to accommodate the ends of the tubes of the respective yarn spools.

5. A divider according to claim 1 wherein:

the main body portion has a rectangular configuration;

the skirt portion includes corner scallops and side scallops intermediate the corner scallops; and each side scallop is circular and has an arcuate extent not exceeding 180°.

6. A divider according to claim 5 where each corner scallop is circular and has an arcuate extent of at least 120°.

7. A divider for use in handling layers of yarn spools of the type including a central tube with yarn wound around the tube, characterized in that:

the divider has a twin sheet construction including upper and lower plastic sheets selectively fused together;

the divider includes a main body generally rectangular and generally planer portion sized to seat a plurality of spools with the tubes on end and formed of portions of the upper and lower sheets selectively fused together to define upper and lower generally planar spaced faces; and the divider further includes a skirt portion extending around the perimeter of the main body portion and formed of upstanding fused together portions of the first and second sheets configured to define a circumferentially spaced series of inwardly opening arcuate scallops each sized to embrace the outer diameter of a yarn spool seated on the main body portion.

8. A divider according to claim 7 wherein each scallop is connected to the main body portion by a strap extending from the main body portion to the scallop and the scallops are connected together to form a continuous circumferential band of scallops.

9. A divider according to claim 8 wherein each strap connects to a central region of the respective scallop.

10. A method of handling a layer of yarn spools, the method comprising:

providing a divider having a main body, generally planar, polygonal portion and a skirt portion extending around the periphery of the main body portion and formed into a series of circumferentially spaced, arcuate, inwardly opening scallops with each scallop having a curvature substantially matching the curvature of the yarn spools;

positioning one of said dividers on a support surface with the skirt portion upstanding; and positioning a layer of spools on the divider with each scallop of the divider engaging an individual outer spool in the layer.

11. A method according to claim 10 wherein the method includes the further steps of:

positioning a further layer of spools on the spool layer; and positioning another of said dividers on top of the further layer of spools with the main body portion overlying the further layer and the skirt portion extending downwardly with each scallop engaging an individual outer spool in the further layer.

12. A method according to claim 11 wherein the method includes the further step of positioning a further of said dividers between the layers of spools with the skirt portion either upstanding or downstanding.

13. A method according to claim 10 wherein the method includes the further steps of connecting each scallop to the main body portion by a strap and connecting the scallops together to form a continuous circumferential band of scallops.

14. A divider for use in handling quantities of yarn spools arranged in layers, the divider including:

a main body generally planar polygonal portion; and a skirt portion extending around the periphery of the main body portion and formed into a series of circumferentially spaced, arcuate, inwardly opening scallops with each scallop having a curvature substantially matching the curvature of the yarn spools so that, with a layer of spools positioned on the main body portion and the skirt upstanding from the main body portion, each scallop may compliantly engage the outer periphery of an individual outer spool of the spool layer, each scallop being connected to the main body portion by a strap extending from the main body portion to a central region of the scallop, and the scallops being connected together by flat portions to form a continuous circumferential band of scallops.

15. A divider for use in handling quantities of yarn spools arranged in layers, the divider including:

a main body generally planar polygonal portion; and a skirt portion extending around the periphery of the main body portion and formed into a series of circumferentially spaced, arcuate, inwardly opening scallops with each scallop having a curvature substantially matching the curvature of the yarn spools so that, with a layer of spools positioned on the main body portion and the skirt upstanding from the main body portion, each scallop may compliantly engage the outer periphery of an individual outer spool of the spool layer, each spool including yarn material wrapped around a central tube, the main body portion further including sockets sized and distributed to accommodate the ends of the tubes of the respective yarn spools, the sockets being provided in an upper face of the main body portion and further sockets being provided in a lower face of the main body portion in respective alignment with the sockets in the upper face.

16. A divider according to claim 15 wherein the sockets are oversize with respect to the diameter of the yarn spool tubes with the extent of oversize increasing progressively in proportion to the distance from the geometric center of the main body portion.

17. A divider according to claim 16 wherein the sockets have a slot configuration with the primary axis of each slot intersecting the geometric center of the main body portion.

18. A divider according to claim 15 wherein the sockets have a depth greater than the extent to which the tube ends project beyond the yarn material whereby to provide a clearance between the ends of the tubes and the bottoms or tops of the sockets.

19. A divider for use in handling quantities of yarn spools arranged in layers, the divider including:

a main body generally planar polygonal portion; and a skirt portion extending around the periphery of the main body portion and formed into a series of circumferentially spaced, arcuate, inwardly opening scallops with each scallop having a curvature substantially matching the curvature of the yarn spools so that, with a layer of spools positioned on the main body portion and the skirt upstanding from the main body portion, each scallop may compliantly engage the outer periphery of an individual outer spool of the spool layer, each spool including yarn material wrapped around a central tube, the main body portion further including sockets sized and distributed to accommodate the ends of the tubes of the respective yarn spools, the divider having a twin sheet construction including upper and lower sheets selectively fused together, the main body portion being defined by spaced portions of the first and second sheets, and the sockets being defined by flat confronting fused together portions of the first and second sheets.

20. A divider according to claim 19 wherein the flat, confronting fused together portions of the first and second sheets lie in a plane intermediate the general plane of the first and second sheets whereby to define upwardly and downwardly opening sockets for accommodating ends of the tubes of the yarn spools.

* * * * *